US011598322B2

(12) United States Patent
Apperger et al.

(10) Patent No.: US 11,598,322 B2
(45) Date of Patent: Mar. 7, 2023

(54) HYDROSTATIC AXIAL PISTON MACHINE OF SWASH PLATE CONSTRUCTION

(71) Applicant: Robert Bosch GmbH, Stuttgart (DE)

(72) Inventors: Andreas Apperger, Eutingen (DE); Erik Leipersberger, Horb Am Neckar (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 17/389,711

(22) Filed: Jul. 30, 2021

(65) Prior Publication Data

US 2022/0074396 A1 Mar. 10, 2022

(30) Foreign Application Priority Data

Sep. 9, 2020 (DE) ..... 10 2020 211 284.3

(51) Int. Cl.

| | |
|---|---|
| ***F04B 1/324*** | (2020.01) |
| ***F04B 1/148*** | (2020.01) |
| ***F04B 1/124*** | (2020.01) |
| ***F04B 1/143*** | (2020.01) |
| ***F04B 5/02*** | (2006.01) |
| ***F04B 15/02*** | (2006.01) |

(Continued)

(52) U.S. Cl.

CPC ..... *F04B 1/148* (2013.01); *F04B 1/124* (2013.01); *F04B 1/143* (2013.01); *F04B 1/324* (2013.01); *F04B 5/02* (2013.01); *F04B 15/02* (2013.01); *F04B 49/12* (2013.01); *F04D 25/04* (2013.01); *F15B 7/08* (2013.01)

(58) Field of Classification Search

CPC ..... F04B 1/324

See application file for complete search history.

(56) References Cited

U.S. PATENT DOCUMENTS 1,918,985 A * 7/1933 Robson ..... F16H 61/42 91/367

2,265,314 A * 12/1941 Rose ..... E21B 19/08 60/449

(Continued)

FOREIGN PATENT DOCUMENTS

DE 1 908 234 A1 8/1970

DE 2 030 844 A1 1/1971

(Continued)

*Primary Examiner* — Thomas Fink

(74) *Attorney, Agent, or Firm* — Maginot, Moore & Beck LLP

(57) ABSTRACT

An axial piston machine has a swash plate and an adjusting device having an adjusting cylinder and a double-acting adjusting piston which is longitudinally movable in the adjusting cylinder and includes a piston and a piston rod, which is fixedly connected to the piston and is articulated to the swash plate. The joint between the adjusting piston and the swash plate is a movable swivel joint having a joint body receptacle on one part and a joint body on the other part of the adjusting piston and the swash plate. The joint body is closely guided in the joint body receptacle in the direction of movement of the adjusting piston, is rotatable about an axis of rotation running parallel to the pivot axis of the swash-plate, and is movable with a directional component perpendicular to the direction of movement of the adjusting piston and perpendicular to the axis of rotation.

9 Claims, 2 Drawing Sheets

(51) Int. Cl.

| | |
|---|---|
| ***F04B 49/12*** | (2006.01) |
| ***F04D 25/04*** | (2006.01) |
| ***F15B 7/08*** | (2006.01) |

(56) References Cited

U.S. PATENT DOCUMENTS

| | | | | | |
|---|---|---|---|---|---|
| 3,554,671 | A * | 1/1971 | Schlinke | F04B 49/08 | 417/222.1 |
| 3,620,130 | A * | 11/1971 | Roberts | F16H 47/04 | 91/506 |
| 3,834,281 | A * | 9/1974 | Heyl | F04B 1/324 | 91/506 |
| 4,896,585 | A * | 1/1990 | Forster | F01B 3/02 | 91/506 |
| 7,367,258 | B2 * | 5/2008 | Wanschura | F04B 1/324 | 91/506 |
| 2005/0252369 | A1 * | 11/2005 | Lilia | F04B 1/324 | 92/13 |
| 2010/0018385 | A1 | 1/2010 | Mori et al. | | |
| 2019/0264564 | A1 | 8/2019 | Komada et al. | | |

FOREIGN PATENT DOCUMENTS

| | | | |
|---|---|---|---|
| DE | 2 204 466 | A1 | 8/1973 |
| DE | 37 14 888 | C2 | 10/1994 |
| DE | 103 51473 | B3 | 7/2005 |
| DE | 10 2012 222 700 | A1 | 6/2014 |
| DE | 10 2013 000 811 | A1 | 7/2014 |
| DE | 10 2014 211 965 | A1 | 12/2015 |
| JP | H5-99127 | A | 4/1993 |
| JP | 2005-320912 | A | 11/2005 |
| JP | 2016-23606 | A | 2/2016 |
| JP | 2016-109025 | A | 6/2016 |

* cited by examiner

HYDROSTATIC AXIAL PISTON MACHINE OF SWASH PLATE CONSTRUCTION

This application claims priority under 35 U.S.C. § 119 to application no. DE 10 2020 211 284.3, filed on Sep. 9, 2020 in Germany, the disclosure of which is incorporated herein by reference in its entirety.

The disclosure relates to a hydrostatic axial piston machine, in particular an axial piston pump, of swash plate construction. The axial piston machine has a housing, a drive shaft rotatably mounted in the housing, a cylinder drum connected to the drive shaft in a rotationally secure manner and having displacement pistons, a swash plate, which is mounted in the housing and has a face on which the displacement pistons are supported and the angular position of which with respect to the axis of rotation of the drive shaft and of the cylinder drum can be varied in order to adjust the swept volume by pivoting the swash plate about a pivot axis. For pivoting the swash plate, there is an adjusting device having an adjusting cylinder, which extends longitudinally substantially in the direction of the axis of rotation of the drive shaft and is located on one side of the drive shaft and of the cylinder drum, and having a double-acting adjusting piston, which can be moved longitudinally in the adjusting cylinder and which comprises a piston and a piston rod, which is connected in a fixed manner to the piston, is guided in a guide bore adjoining the adjusting cylinder and is articulated to the swash plate.

BACKGROUND

DE 10 2014 211 965 A1 discloses an axial piston pump in which use is made of two single-acting adjusting pistons to adjust the swash plate to a larger swivel angle and to a smaller swivel angle, of which adjusting pistons a first, larger adjusting piston adjoins an actuating chamber for which the inflow and the outflow of pressure fluid is controlled by means of a control valve, and of which adjusting pistons a smaller adjusting piston, also referred to as an opposing piston, adjoins a second actuating chamber, which is permanently connected to the high-pressure side of the axial piston pump, in which therefore high pressure is constantly present during operation. In this case, the longitudinal axes of the two adjusting pistons run parallel to the axis of the drive shaft of the axial piston pump. The adjusting pistons rest by means of a bearing surface against a respective sliding shoe, which is mounted on a ball journal inserted into the swash plate so as to be pivotable in all directions. A movement in a plane perpendicular to the axis of the drive shaft is possible between the bearing surface of an adjusting piston and the associated sliding shoe when the swash plate is adjusted.

In a hydrostatic axial piston pump known from DE 103 51 473 A1, the swash plate can be pivoted about a pivot axis which is at a distance from the axis of rotation of the drive shaft and of the cylinder drum. The swash plate can be pivoted in one direction by a single-acting adjusting piston and in the opposite direction by the drive mechanism forces and a helical compression spring. Although the axial piston pump has an adjusting device of low complexity here, it has disadvantages with regard to some functionalities, such as a limited force level for adjustment and limited pivotability of the swash plate through a zero position.

DE 1 908 234 A discloses a hydrostatic axial piston pump of swash plate construction in which, in order to adjust the swept volume, the swash plate is pivoted with the aid of a double-acting adjusting piston. The adjusting piston adjoins a first actuating chamber, for which the inflow and the outflow of pressure fluid is controlled by means of a control valve, and adjoins an annular actuating chamber of smaller cross section, in which a high pressure is constantly present. The piston of the adjusting piston can be moved only in a straight line and cannot be tilted and is motionally coupled in a complicated manner to the swash plate by means of a coupling rod, which is connected to the piston via a first swivel joint and to the swash plate via a second swivel joint.

DE 37 14 888 C2 discloses a hydrostatic axial piston machine of swash plate construction which has a double-acting annular adjusting piston which surrounds the cylinder drum and which comprises a circular cylindrical bushing that is guided at both ends in the direction of the axis of rotation of the drive shaft and carries on the outside a ring which divides an annular space between the housing and the bushing into two actuating chambers. The bushing of the adjusting piston is motionally coupled to the swash plate via a ball joint and a sliding joint. The sliding joint is formed between a driver pin on the swash plate and a spherical bushing, which is movable on the driver pin in the axial direction thereof. The ball joint is formed between the spherical bushing and an internally spherically formed retaining ring, which is inserted into the adjusting piston bushing and receives the spherical bushing. Here, therefore, surface contact between the spherical bushing and the retaining ring and thus the adjusting piston is sought.

SUMMARY

The object underlying the disclosure is that of developing a hydrostatic axial piston machine of the type described at the outset in such a way that the adjusting device is of simple and inexpensive construction and requires little installation space.

This object is achieved for a hydrostatic axial piston machine of the type specified at the outset in that the joint between the adjusting piston and the swash plate is a movable swivel joint, which comprises a joint body receptacle on one part and a joint body on the other part of the two parts comprising the adjusting piston and the swash plate, and in that the joint body is closely guided in the joint body receptacle in the direction of movement of the adjusting piston, can be rotated about an axis of rotation running parallel to the pivot axis and can be moved with a directional component perpendicular to the direction of movement of the adjusting piston and perpendicular to the axis of rotation. According to the disclosure, only linear contact is provided between the joint body and the joint body receptacle. There is no component with a cylindrically or spherically curved inner surface against which the joint body would rest over an extended area. As a result, the articulated connection between the adjusting piston and the swash plate is of simple configuration and can be produced inexpensively. Moreover, assembly is simple because, with the adjusting piston already inserted, the joint body can easily be pushed into the joint body receptacle when the swash plate is inserted.

A hydrostatic axial piston machine according to the disclosure can be further developed in an advantageous manner.

The joint body receptacle is preferably located in the adjusting piston and the joint body is preferably located on the swash plate. An adjusting piston provided with a joint body receptacle, i.e. with a recess, can easily be inserted into the adjusting cylinder. Thereafter, there is no longer need for manipulations of the adjusting piston. The swash plate, on the other hand, can easily be assembled with a projecting joint body.

Even if the adjusting cylinder and the adjusting piston are arranged in such a way that the adjusting piston is movable not parallel but slightly obliquely to the axis of rotation of the drive shaft, it is preferred that the joint body receptacle located in the adjusting piston extends perpendicularly to the direction of movement of the adjusting piston, thus enabling the joint body to be moved in the joint body receptacle perpendicularly to the direction of movement of the adjusting piston. The force which is necessary for adjusting the swash plate thus acts on the adjusting piston in the longitudinal direction thereof.

It is conceivable for the joint body to be a roller which extends into an elongate joint body receptacle. However, the joint body preferably has a spherical surface. The joint body receptacle is a receiving hole whose diameter, in accordance with a clearance fit, is slightly larger than the diameter of the spherical surface and into which the joint body enters by means of the spherical surface.

The joint body can be a ball journal, which is fastened, in particular, to the swash plate, in particular being pressed in or screwed in. Alternatively, it is also possible for a ball to be machined directly on the swash plate.

The joint body can also be a spherical cap bearing, i.e. a bushing with a spherical outer surface, which is held on a journal, in particular of the swash plate.

The receiving hole for a spherical joint body is preferably designed as a blind hole, thus ensuring that the adjusting piston still has sufficient stability in the region of the receiving hole. To ensure that no excess pressure or reduced pressure builds up between the joint body having the spherical surface and the bottom of the receiving hole during a movement of the joint body, the region of the receiving hole located in front of the joint body is fluidically connected to the interior of the housing.

In particular, a relief hole, the diameter of which is substantially smaller than the diameter of the receiving hole, leads outwards through material of the adjusting piston from the region of the receiving hole located in front of the joint body. Thus, there is no need for a groove in the surface of the joint body to relieve said region.

The receiving hole is preferably located in an axial plane which passes through the longitudinal axis of the adjusting piston, i.e. the axis of the receiving hole intersects the longitudinal axis of the adjusting piston. The spherical surface of the joint body is then advantageously arranged at such a distance from the pivot axis of the swash plate that the longitudinal axis of the adjusting piston extends at a distance outside the circular arc on which the center of the spherical surface of the joint body moves when the swash plate pivots. This can also be ensured, in the case of an adjusting piston arranged obliquely with respect to the axis of rotation of the drive shaft, if the joint body is arranged on the swash plate in such a way that, when the swash plate is pivoted from a first extreme position into a second extreme position, the distance between the center of the spherical surface of the joint body and the central axis of the adjusting piston initially decreases and then increases again.

The piston rod is not guided in every position over its entire length by the guide bore since the outlay for producing a straight guide bore increases with the length of the guide bore. The guide bore is preferably only long enough that the piston rod still projects beyond the guide bore when it is completely retracted, thus ensuring that the length of guidance of the piston rod in the guide bore is independent of the position of the adjusting piston. However, it is advantageous if the length of guidance of the piston rod in the guide bore is greater on the side remote from the cylinder drum than on the side close to the cylinder drum. At its end remote from the adjusting cylinder, the guide bore therefore ends at different distances from the adjusting cylinder. As a result, a tilting moment acting on the adjusting piston is well absorbed. This is based on the consideration that the pressure acting in a fluid chamber on the piston section of the adjusting piston decreases to the housing pressure via the gap between the guide bore and the piston rod. The longer the gap, the greater the force generated by the pressure in the gap. By means of a different length of guidance and thus gap length, it is therefore possible to generate a resultant transverse force acting on the adjusting piston.

The piston of the adjusting piston can have on the outside an annular groove in which there is a piston ring resting against the wall of the adjusting cylinder. The guidance for the adjusting piston is thus provided solely by the piston rod on a single diameter, and therefore no stiffness is to be expected.

If an axial piston machine according to the disclosure is (also) operated as an axial piston pump, then preferably at least one return spring designed as a helical compression spring is present, which is arranged in front of the piston rod in a receptacle of the housing and is clamped between the housing and the piston rod of the adjusting piston and the axis of which coincides with the axis of the adjusting piston. The return spring is thus loaded in a purely linear manner. Its two ends are supported on mutually parallel surfaces. The return spring ensures that the swash plate assumes a preferred position, preferably a fully pivoted-out position, when the axial piston machine is out of operation. At the beginning of operation, the axial piston machine delivers immediately, thus enabling a pressure build-up.

BRIEF DESCRIPTION OF THE DRAWINGS

Two exemplary embodiments of an axial piston machine according to the disclosure of swash plate construction are illustrated in the drawings. The disclosure is now explained in greater detail with reference to the figures of these drawings.

In the drawings.

DETAILED DESCRIPTION

First of all, the embodiment shown in FIG. 1 will be described here. Subsequently, essentially only what distinguishes the second exemplary embodiment from the first exemplary embodiment will be discussed.

Figure 1:
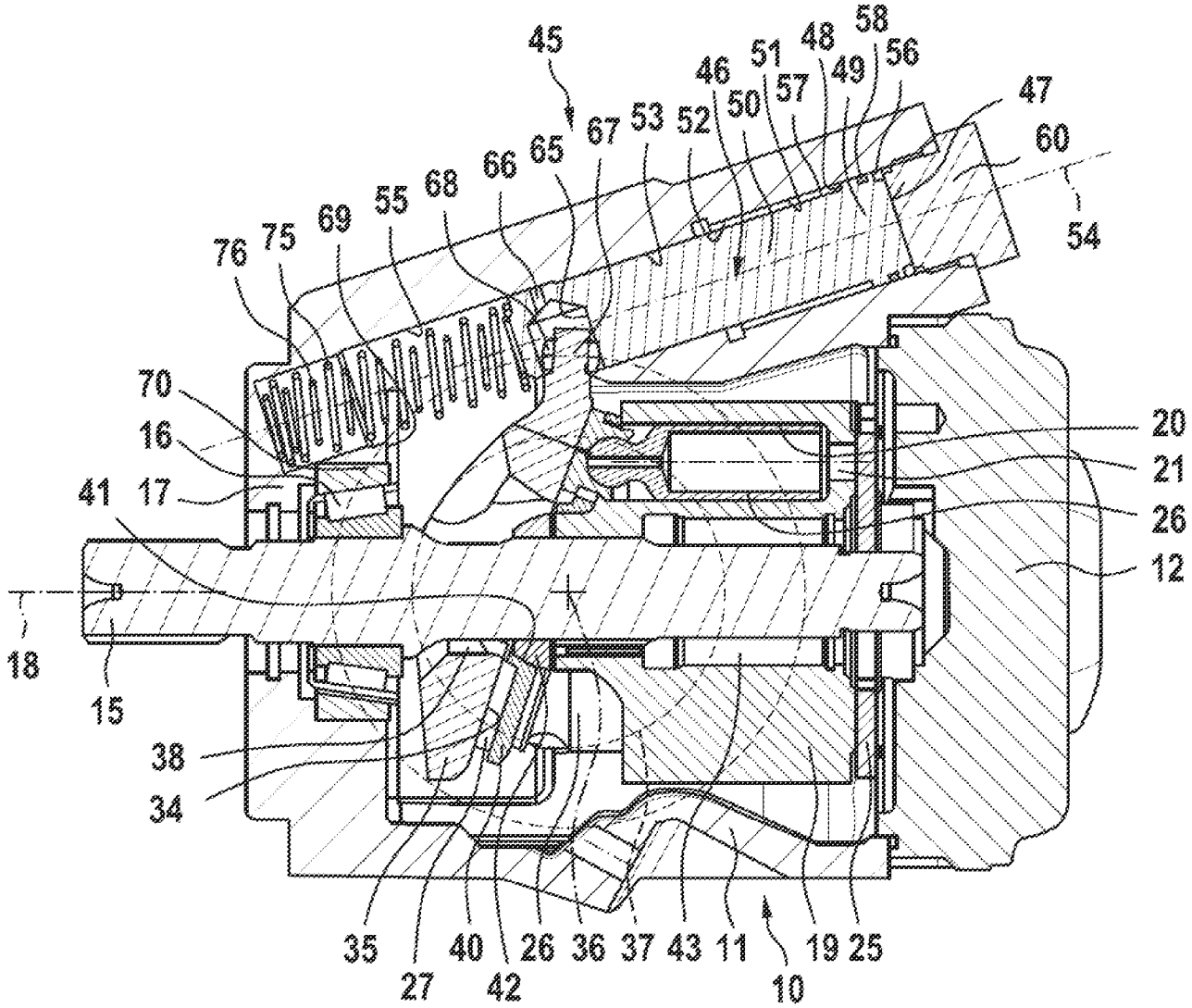
FIG. 1 shows a longitudinal section through the first exemplary embodiment, in which the joint body is a spherical bushing held on the swash plate.

The hydrostatic axial piston machine according to FIG. 1 is intended for operation as a pump and as a motor. It has a two-part housing 10 with a housing pot 11 and a connection plate 12, which closes the open side of the housing pot and on which a pressure connection and a tank connection are formed in a manner not shown specifically. A channel (not shown specifically) extends from the pressure connection and from the tank connection and opens into a kidney-shaped opening on the inside of the connection plate 12.

The axial piston machine has a drive shaft 15, which is mounted rotatably about an axis of rotation 18 by means of a first taper roller bearing 16, which is inserted into the bottom 17 of the housing pot 11, and a second taper roller bearing (not shown), which is accommodated by the connection plate 12. A cylinder drum 19 is connected to the drive shaft 15 in a rotationally secure but axially movable manner and has an odd number, for example nine, of piston bores 20, which are arranged at equal angular spacings on a pitch circle and are aligned parallel to the axis of rotation 18 and are open with their entire cross section towards the end of the cylinder drum 19 remote from the connection plate 12 while, at the end of the cylinder drum facing the connection plate 12, they open into arcuate orifice slots 21 lying on the same pitch circle.

Arranged between the cylinder drum 19 and the connection plate 12 is a distributor plate 25, which is held non-rotatably with respect to the connection plate 12 and which has two kidney-shaped control apertures in the form of circular arcs, which are not visible in the section according to FIG. 1, which lie on the same pitch circle as the orifice slots 21 and of which one covers one kidney-shaped opening in the connection plate 12 and is thus fluidically connected to the pressure connection and the other covers the other kidney-shaped opening in the connection plate and is thus fluidically connected to the tank connection of the axial piston machine. Thus, when the cylinder drum 19 rotates with the drive shaft 15, a piston bore 20 is alternately connected via its orifice slot 21 to the pressure connection and to the tank connection.

A displacement piston 26 is accommodated in each piston bore 20 and carries a sliding shoe 27, which is movable in all directions, on a piston head located outside the piston bore 20. Via its sliding shoe, each displacement piston 26 rests against a face 34 of a swash plate 35, which is mounted pivotably about a pivot axis 36 in two bearing shells inserted into the housing pot 11. The pivot axis 36 intersects the axis of rotation 18 of the drive shaft 15 at a right angle and extends perpendicularly to the plane of the drawing of FIG. 1. The circular cylinder on which the bearing surfaces of the bearing shells and the swash plate 35 are located is indicated in FIG. 1 by the dashed circular line 37. Centrally, the swash plate 35 has a large opening 38 for the entry of the drive shaft 15.

To ensure that, after a displacement stroke during which they are pushed into the piston bores 20, the displacement pistons 26 remain securely on the face 34 of the swash plate 35 and move out of the piston bores in the suction stroke, a retraction plate 40 rests on a shoulder of the sliding shoes 27 and bears with a central rim hole 41 against a retraction ball 42, which is constructed in the manner of a spherical layer and is coupled in a rotationally secure but axially movable manner to the drive shaft 15. A helical compression spring, which is omitted in FIG. 1, is accommodated in an annular intermediate space 43 between the drive shaft 15 and the cylinder drum 19 and is supported, on the one hand, on the cylinder drum 19 via a retaining ring and, on the other hand, on the retraction ball via a supporting disk and pressure pins extending along the toothing between the drive shaft 15 and the cylinder drum 19. Thus, on the one hand, by means of the helical compression spring, the cylinder drum 19 is pressed against the distributor plate 25 and the latter against the connection plate 12, and, on the other hand, the sliding shoes 27 are pressed against the swash plate 35 via the retraction ball 42 and the retraction plate 40, and thus, during the suction stroke, the displacement pistons 26 are pulled out of the piston bores 20.

To change the angular position of the swash plate 35, the axial piston machine has an adjusting device 45, which comprises a double-acting adjusting piston 46, which is designed as a differential piston with two effective surfaces of different sizes, the larger of which is referred to as the actuating surface 47 and the smaller one as the counter surface 48. The adjusting piston 46 has a piston section 49 on which the effective surfaces are formed, and a piston rod 50, which projects away from the piston section 49 on one side. The piston section 49 and the piston rod 50 of the adjusting piston 46 can be moved rectilinearly in the longitudinal direction in a stepped housing bore 51 extending slightly obliquely to the axis of rotation 18 of the drive shaft 15, the piston section 49 being located in the bore section 52 of the housing bore 51 which has the larger diameter and forms an adjusting cylinder, while the piston rod 50 is guided in a longitudinally movable manner in the bore section 53 with the smaller diameter. The central axis 54 of the housing bore 51 and of the adjusting piston 46 is drawn as a dashed line in FIG. 1. The movement of the adjusting piston 46 takes place in the direction of this central axis 54.

Bore section 53 has a length such that, even when the piston rod 50 is completely retracted, it still projects by a certain distance beyond bore section 53 and projects into a section 55 of the housing bore 51 in which the diameter is slightly larger than in bore section 53. The piston rod 50 is thus always guided over the same length, irrespective of the position of the adjusting piston.

The piston section 49 of the adjusting piston 46 divides bore section 52 of the housing bore 51 into an actuating chamber 56, the cross section of which corresponds to bore section 52 and the actuating surface 47 of the adjusting piston 46, and into a counter chamber 57, which has an annular cross section, the outside diameter of which is equal to the diameter of bore section 52 and the inside diameter of which is equal to the outside diameter of the piston rod 50 and which corresponds to the counter surface 48 of the adjusting piston 46. The actuating surface 47 is approximately three times as large as the counter surface 48. The counter chamber 57 is permanently fluidically connected to the pressure connection of the axial piston machine. Thus, it is the high pressure which prevails in the counter chamber 57. This pressure generates a force on the annular counter surface 48 of the adjusting piston 46 which acts in the direction of retraction of the piston rod 50. A piston ring 58 is inserted into a circumferential annular groove of the piston section 49 in order to seal the actuating chamber 56 and the counter chamber 57 from one another.

The length of guidance and thus also the gap length between bore section 53 and the piston rod 50 are greater on the outside of bore section 53 than on the inside located toward the interior of the housing 10. Accordingly, the gap length over which the pressure acting in the counter chamber 57 decreases to the housing pressure is also greater on the outside than on the inside. In FIG. 1, the dashed line indicates the oblique course of the end 59 of bore section 53 remote from the counter chamber. The reduction of the pressure acting in the counter chamber 57 over different gap lengths over the circumference of bore section 53 leads to a transverse force acting on the adjusting piston, which acts against a tilting moment generated by a force exerted on the adjusting piston by the spherical bushing, thus ensuring that the adjusting piston moves without tilting.

The housing bore 51 is closed off from the outside by a screw plug 60.

The actuating chamber 56 can be controlled by a single or by a plurality of control valves, which connect the actuating chamber to a pressure fluid source or to a tank, or shut off the actuating chamber both from the pressure fluid source, which can also be formed by the pressure connection of the machine, and from the tank. When the actuating chamber 56 is connected to a pressure fluid source, pressure fluid flows to the actuating chamber and the piston rod 50 is extended. When the actuating chamber 53 is connected to the tank, pressure fluid can be displaced out of the actuating chamber and the piston rod 50 is retracted. When the actuating chamber 56 is shut off, the piston rod remains at rest.

A blind hole 65 extending perpendicularly to the central axis 54 is introduced into the piston rod 50 of the adjusting piston 46 close to the free end and extends perpendicularly to the central axis 54, from which hole a smaller hole 66 leads outwards into the section 55 of the housing bore 51.

A journal 67 is formed integrally on the swash plate 35, onto which journal a spherical bushing 68 is pushed as far as a shoulder and is held on the shoulder by a retaining ring. The diameter of the spherical surface of the spherical bushing 68 is equal to the diameter of the blind hole 65. The journal 67, together with the spherical bushing 68, passes through an opening 69 of the section 55, which opening is elongate in the direction of the central axis 54 of the adjusting piston 46 and of the housing bore 51, into the blind hole 65 of the adjusting piston 46. If the play necessary for the mobility of the spherical bushing in the blind hole is disregarded, the line of contact between the spherical bushing 68 and the wall of the blind hole, that is to say the adjusting piston 46, is a circle.

If the adjusting piston 46 now moves, the spherical bushing 68 is taken along in both directions of movement and the swash plate 35 is thereby pivoted. In this case, the depth to which the spherical bushing 68 penetrates into the blind hole 65 and the position of the contact line between the spherical bushing and the adjusting piston along the blind hole also change. At the same time, the spherical cap 68 rotates with respect to the adjusting piston 46 about an axis of rotation which runs parallel to the pivot axis 36 and moves with the depth of penetration. The joint between the adjusting piston 46 and the swash plate 35 is thus a movable swivel joint, in particular a movable ball joint with the spherical bushing 68 held on the swash plate 35 as the joint body and the blind hole 65 on the adjusting piston 46 as the joint body receptacle.

FIG. 1 shows in dashed lines a circle 70, the center of which lies on the pivot axis 36 of the swash plate 35 and which lies in a plane perpendicular to the pivot axis 35. When the swash plate 35 is adjusted, the center of the spherical surface of the spherical bushing 68 moves on a part of this circle 70. FIG. 1 shows the swash plate 35 in a position pivoted to the maximum extent in the one direction with respect to a zero position, in which the face 34 is perpendicular to the axis of rotation 18 of the drive shaft 15. The journal 67 and the spherical bushing are at one end of the elongate opening 69 of the housing 10. A first maximum distance exists between the center of the spherical surface of the spherical bushing 68 and the central axis 54. If, starting from the position shown in FIG. 1, the swash plate is now pivoted counterclockwise in the view according to FIG. 1 by extending the adjusting piston 46, the distance between the center and the central axis initially decreases and then increases again in order to be maximum after pivoting of the swash plate via the zero position into a position pivoted to the maximum extent in the other direction. The center of the spherical surface of the spherical bushing 68 thus does not come to be on the central axis 54 of the adjusting piston in any angular position of the swash plate 35. If this were the case, it would be possible for the adjusting piston 46 to rotate about its central axis 54 to the extent that the journal 67 would permit this. Because the distance between the center and the central axis is always greater than zero, rotation of the adjusting piston is avoided.

In the case of a position of the swash plate 35 between the zero position and one maximally pivoted position, the axial piston machine operates as a pump. In the case of a position of the swash plate 35 between the zero position and the other maximum pivoted position, the axial piston machine operates as a motor with the same direction of rotation and without a change between the pressure connection and the tank connection.

The adjusting device 45 further comprises two actuating springs 75 and 76, which are arranged concentrically with one another, are designed as helical compression springs and are clamped between the bottom of the housing bore 51 and the adjusting piston. The actuating springs are thus loaded in the direction of their longitudinal axis and act in the direction of retraction of the adjusting piston 46. The swash plate 35 thus assumes the position shown in FIG. 1, pivoted out to the maximum extent in one direction, when there is no pressure in the actuating chamber and in the counter chamber. It is thus ensured that the machine begins to deliver immediately in pump mode at the start of operation without the adjusting device having to be supplied with pressure fluid from a source of external pressure.

Figure 2:
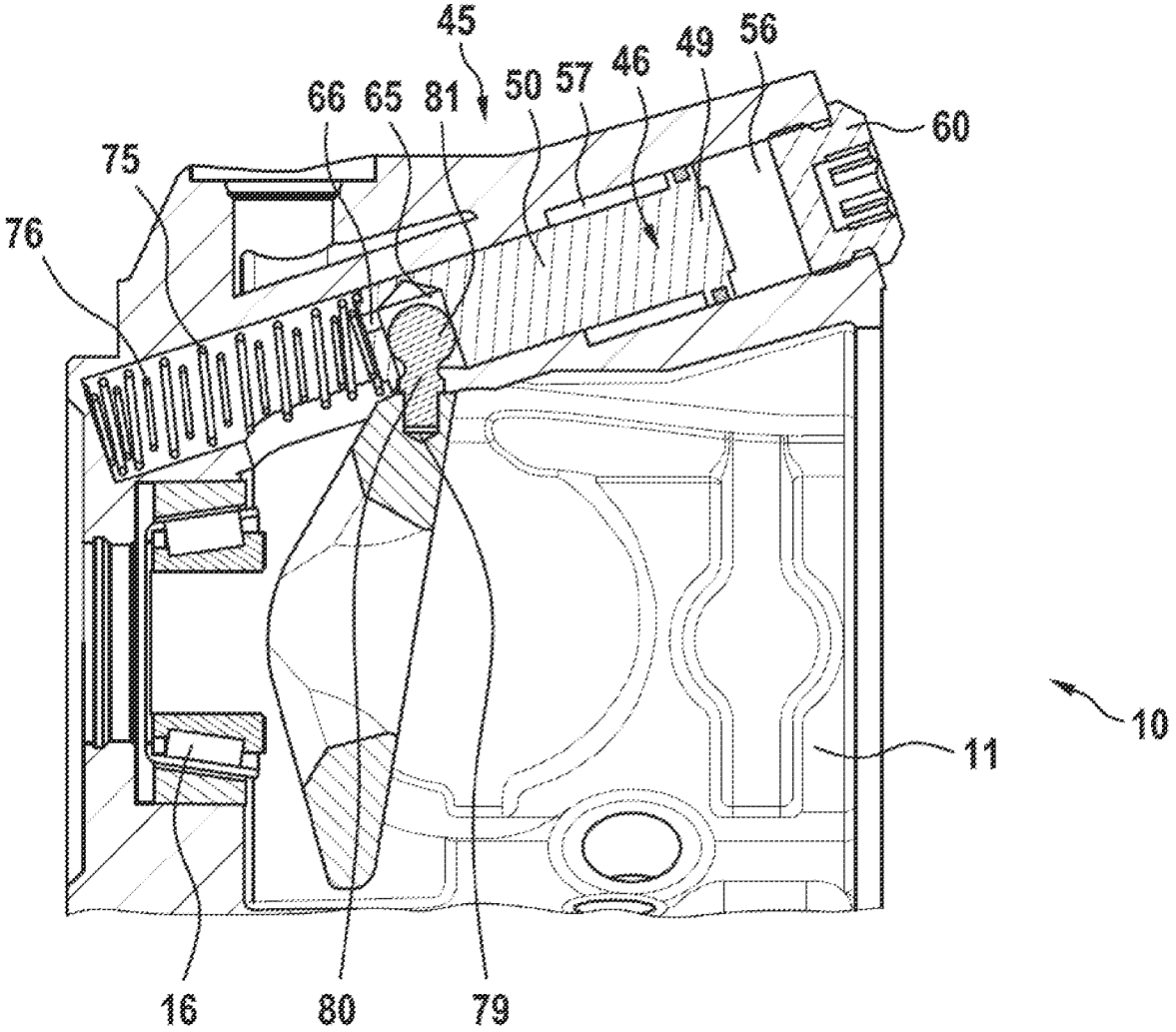
FIG. 2 shows a longitudinal section through the second exemplary embodiment, which is equipped only with the components essential for explaining the disclosed embodiment, in which the joint body is a ball journal pressed into the swash plate.

Of the exemplary embodiment shown in FIG. 2, only the housing 10, the swash plate 35, the adjusting piston 46 and the two actuating springs 75 and 76 are shown.

In contrast to the first exemplary embodiment, in the second exemplary embodiment a ball journal 80 is pressed into a hole 79 in the swash plate 35, which ball journal penetrates with its ball head 81 into the blind hole 65 of the adjusting piston 46 and by means of which the adjusting piston 46 is able to pivot the swash plate 35.

In contrast to the first exemplary embodiment, the bore section 53 in which the piston rod 50 of the adjusting piston 46 is guided reaches as far as the bottom of the housing bore 51, thus ensuring that, irrespective of the position of the adjusting piston 46, the piston rod is always guided over its length located outside bore section 52 and, apart from the region of the opening 69 between the housing bore 51 and the interior of the housing 10, and the gap length between the piston rod 50 and bore section 53 depends on the position of the adjusting piston 46.

In the second exemplary embodiment, a relief hole 66 for the blind hole 65 leads in the axial direction of the adjusting piston 46 into the blind hole 65 because, owing to the narrow gap radially outside the piston rod 50, radially no pressure equalization, or at least no rapid pressure equalization, is possible.

LIST OF REFERENCE SIGNS

10 two-part housing
11 housing pot of 10
12 connection plate of 10
15 drive shaft
16 taper roller bearing
17 bottom of 11
18 axis of rotation of 15
19 cylinder drum

20 piston bore
21 orifice slot of 20
25 distributor plate
26 displacement piston
27 sliding shoe
34 face on 35
35 swash plate
36 pivot axis of 35
37 circular line
38 central opening in 35
40 retraction plate
41 central rim hole in 40
42 retraction ball
43 annular intermediate space
45 adjusting device
46 adjusting piston
47 actuating surface
48 counter surface
49 piston section of 46
50 piston rod
51 housing bore
52 bore section of 51
53 bore section
54 central axis of 46
55 section of 51
56 actuating chamber
57 counter chamber
58 piston ring
59 end of 53
60 screw plug
65 blind hole
66 hole
67 journal on 35
68 spherical bushing
69 opening 69 in 55
70 circular line
75 actuating spring
76 actuating spring
79 hole in 35
80 ball journal
81 ball head of 80

The invention claimed is:

1. A hydrostatic axial piston machine of swash plate construction, comprising:

a housing;

a drive shaft mounted in the housing rotatably about a first axis of rotation;

a cylinder drum connected in a rotationally secure manner to the drive shaft and having displacement pistons;

a swash plate mounted in the housing, the swash plate having a face on which the displacement pistons are supported and, by pivoting the swash plate about a pivot axis of the swash plate, the angular position of the face with respect to the first axis of rotation is variable to adjust a swept volume displaced by the displacement pistons; and an adjusting device comprising:

an adjusting cylinder, which extends obliquely with respect to the first axis of rotation and is located on one side of the drive shaft and of the cylinder drum; and a double-acting adjusting piston, which is longitudinally movable in the adjusting cylinder and comprises a piston section and a piston rod, the piston rod being connected in a fixed manner to the piston section, guided in a guide bore adjoining the adjusting cylinder, and articulated to the swash plate, wherein:

a joint between the adjusting piston and the swash plate is a movable swivel joint, which comprises a joint body on the swash plate, and a joint body receptacle defined in the adjusting piston, the joint body is (i) guided in the joint body receptacle such that the joint body is movable with a directional component in a direction of movement of the adjusting piston, (ii) rotatable relative to the joint body receptacle about a second axis of rotation running parallel to the pivot axis of the swash plate, and (iii) movable relative to the joint body receptacle with a directional component perpendicular to the direction of movement of the adjusting piston and perpendicular to the second axis of rotation, the joint body has a spherical surface, and the joint body receptacle is a receiving hole having a diameter that is larger than a diameter of the spherical surface, the receiving hole has a receiving hole central longitudinal axis, the receiving hole central longitudinal axis and a central longitudinal axis of the adjusting piston defining a plane, a center of the spherical surface moves on a circular arc defined in the plane as the swash plate pivots, the center of the spherical surface is arranged at a first distance from the pivot axis of the swash plate such that the circular arc is spaced apart from the central longitudinal axis of the adjusting piston in a direction towards the pivot axis of the swash plate and does not intersect the central longitudinal axis of the adjusting piston.

2. The hydrostatic axial piston machine according to claim 1, wherein the receiving hole central longitudinal axis extends perpendicularly to the central longitudinal axis of the adjusting piston.

3. The hydrostatic axial piston machine according to claim 1, wherein the joint body is a ball that defines the spherical surface, the ball being fastened via being pressed in or screwed in to the swash plate.

4. The hydrostatic axial piston machine according to claim 1, wherein the joint body includes a spherical bushing that forms the spherical surface, the spherical bushing being held on a journal.

5. The hydrostatic axial piston machine according to claim 1, wherein the receiving hole is a blind hole having a region located at an opposite side of the joint body from the swash plate, and a compensating hole leads from the region out of the adjusting piston, the compensating hole having a diameter that is smaller than a diameter of the receiving hole.

6. The hydrostatic axial piston machine according to claim 1, wherein, when the swash plate is pivoted from a first extreme position into a second extreme position, a second distance between the center of the spherical surface of the joint body and the central longitudinal axis of the adjusting piston initially decreases and then increases again.

7. The hydrostatic axial piston machine according to claim 1, wherein the piston rod is guided in the guide bore over a first length on a side of the guide bore that is remote from the cylinder drum and over a second length on a side of the guide bore that is close to the cylinder drum, the first length being greater than the second length.

8. The hydrostatic axial piston machine according to claim 1, wherein an outside of the piston section of the adjusting piston has an annular groove in which a piston ring rests against a wall of the adjusting cylinder.

9. The hydrostatic axial piston machine according to claim 1, further comprising:

at least one actuating spring configured as a helical compression spring clamped between the housing and the piston rod of the adjusting piston, the at least one actuating spring being arranged in a receptacle of the housing that is on an opposite side of the swash plate from the cylinder drum, wherein an axis of the at least one actuating spring coincides with the central longitudinal axis of the adjusting piston and the at least one actuating spring is loaded linearly.

* * * * *